US008632315B2

(12) United States Patent
Headley

(10) Patent No.: US 8,632,315 B2
(45) **Date of Patent: *Jan. 21, 2014**

(54) AIR MOTOR HAVING CERAMIC VALVES

(75) Inventor: Thomas R. Headley, Roanoke, IN (US)

(73) Assignee: Ingersoll-Rand Company, Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/574,960

(22) PCT Filed: Jan. 28, 2011

(86) PCT No.: PCT/US2011/022960

§ 371 (c)(1),
(2), (4) Date: Jul. 24, 2012

(87) PCT Pub. No.: WO2011/094567

PCT Pub. Date: Aug. 4, 2011

(65) Prior Publication Data

US 2012/0308420 A1 Dec. 6, 2012

Related U.S. Application Data

(60) Provisional application No. 61/299,828, filed on Jan. 29, 2010.

(51) Int. Cl.
*F04B 49/00* (2006.01)

(52) U.S. Cl.
USPC ..... 417/46; 417/375; 417/379; 417/384; 137/625.15

(58) Field of Classification Search
USPC ..... 417/46, 245, 318, 375, 379, 384; 137/625.15, 567.15
See application file for complete search history.

(56) References Cited

U.S. PATENT DOCUMENTS

| | | | | |
|---|---|---|---|---|
| 4,181,066 | A | 1/1980 | Kitchen | |
| 4,355,761 | A * | 10/1982 | Bjorn et al. | 239/126 |
| RE35,545 | E * | 7/1997 | Chrysler | 137/315.11 |
| 6,123,008 | A | 9/2000 | Scherer | |
| 6,722,256 | B2 | 4/2004 | Roberts | |
| 6,736,612 | B2 | 5/2004 | Gibbons | |

OTHER PUBLICATIONS

International Search Report and Written Opinion of PCT/US2011/022960, dated Oct. 24, 2011.
International Preliminary Report on Patentability for Application No. PCT/US2011/022960 dated Aug. 9, 2012 (5 pages).

* cited by examiner

*Primary Examiner* — Charles Freay
*Assistant Examiner* — Patrick Hamo
(74) *Attorney, Agent, or Firm* — Michael Best & Friedrich LLP

(57) ABSTRACT

An air motor includes ceramic valves and valve plates to enhance performance and efficiency of the air motor.

20 Claims, 15 Drawing Sheets

AIR MOTOR HAVING CERAMIC VALVES

CROSS REFERENCE TO RELATED APPLICATION

This application claims priority to U.S. Provisional Patent Application No. 61/299,828, filed Jan. 29, 2010, the entire contents of which are herein incorporated by reference.

BACKGROUND

The present invention relates to an air motor having ceramic valves and valve plates to enhance performance of the air motor. The ceramic valves and valve plates reduce sticking, better accommodate debris, and better resist wear than conventional metal or composite valves and valve plates.

SUMMARY

In one embodiment, the invention provides an air motor comprising: a motive fluid inlet (335) adapted to receive a flow of motive fluid; a cylinder (615); a piston (620) within the cylinder (615), the piston (620) dividing the cylinder (615) into an upper chamber (635) above the piston (620) and a lower chamber (640) below the piston (620); a valve chamber (355) including a pilot chamber portion (515); a spool valve (360) shiftable between first and second positions, the spool valve (360) including a reduced diameter section (480) and an enlarged diameter section (485), the enlarged diameter section (485) being exposed to the pilot chamber portion (515); a ceramic D-valve plate (375) including a first D-valve port (455) communicating with the upper chamber (635), a second D-valve port (460) communicating with the lower chamber (640), and a D-valve exhaust port (465) communicating with atmosphere; a ceramic D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position; a ceramic pilot valve plate (385) including a first pilot port (470) communicating with the pilot chamber portion (515) and a second pilot port (475) communicating with atmosphere; a ceramic pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position; an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position; and an output rod (710) interconnected for reciprocal movement with the piston (620) and adapted to perform work.

In another embodiment, the invention provides a pump assembly comprising: a motive fluid inlet (335) adapted to receive a flow of motive fluid; a cylinder (615); a piston (620) within the cylinder (615), the piston (620) dividing the cylinder (615) into an upper chamber (635) above the piston (620) and a lower chamber (640) below the piston (620); a valve chamber (355) including a pilot chamber portion (515); a spool valve (360) shiftable between first and second positions, the spool valve (360) including a reduced diameter section (480) and an enlarged diameter section (485), the enlarged diameter section (485) being exposed to the pilot chamber portion (515); a ceramic D-valve plate (375) including a first D-valve port (455) communicating with the upper chamber (635), a second D-valve port (460) communicating with the lower chamber (640), and a D-valve exhaust port (465) communicating with atmosphere; a ceramic D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position; a ceramic pilot valve plate (385) including a first pilot port (470) communicating with the pilot chamber portion (515)

and a second pilot port (475) communicating with atmosphere; a ceramic pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position; an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position; an output rod (710) interconnected for reciprocal movement with the piston (620); and a piston pump (120) including a pump cylinder (170), an outlet (175), and a one-way valve supported for reciprocation within the pump cylinder (170) and operable to move fluid from below the one-way valve toward the outlet (175), the one-way valve being interconnected with the output rod (710) to cause reciprocation of the one-way valve to move a fluid to be pumped from within the cylinder (170) out the outlet (175) to a desired destination.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
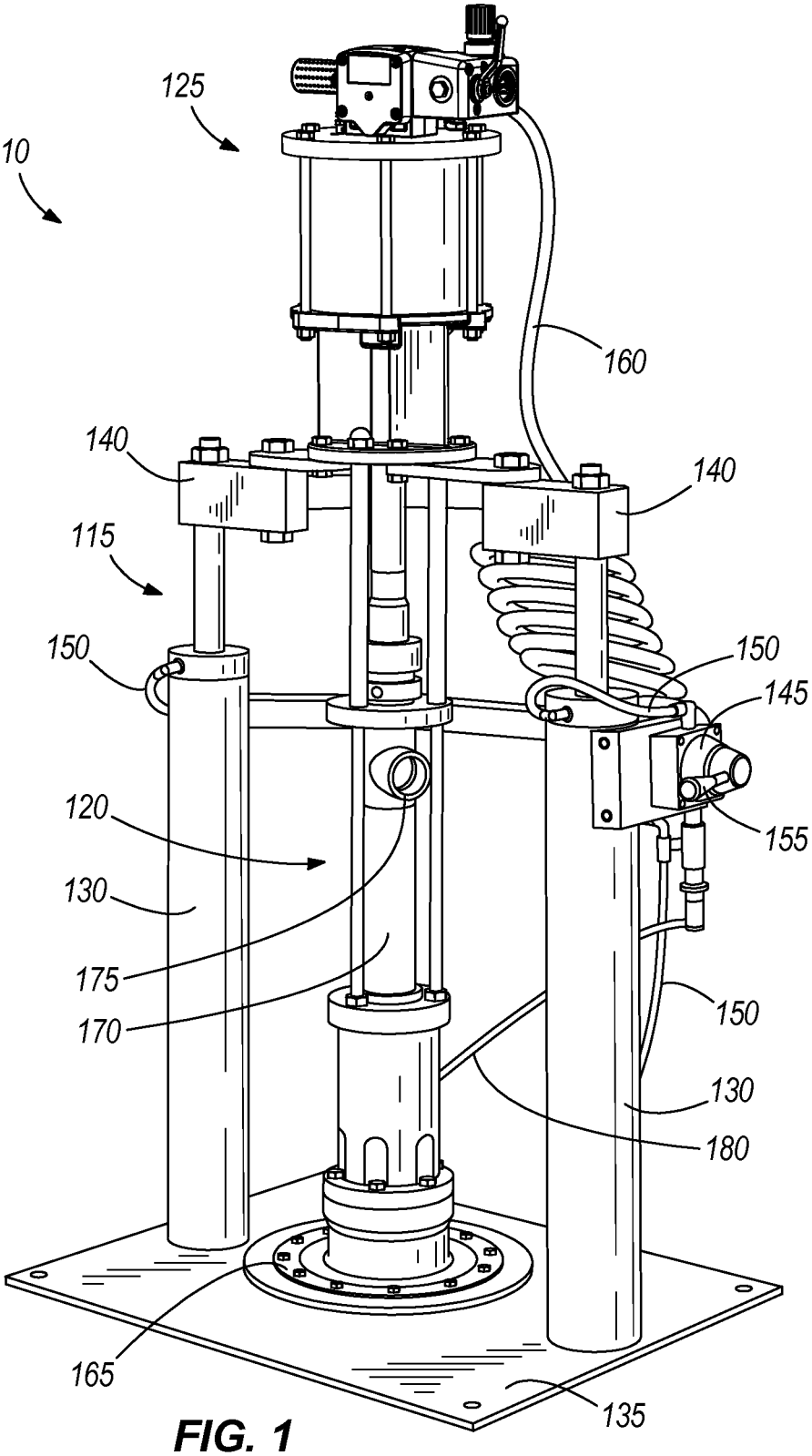
FIG. 1 is a perspective view of a piston pump according to some embodiments of the present invention.

FIG. 1 illustrates a piston pump assembly 110 according to one embodiment of the present invention. The piston pump assembly 110 includes a stand 115, a piston pump 120, and an air motor 125. The stand 115 includes first and second rams 130 and a base plate 135. The air motor 125 and piston pump 120 are mounted to support blocks 140 at the top of each of the rams 130. The air motor 125 is above the support blocks 140 and the piston pump 120 is below the support blocks 140, directly beneath the air motor 125.

A supply of motive fluid 145 communicates with the top and bottom end of each of the first and second rams 130 via ram hoses 150. In this disclosure, the term "motive fluid" means any fluid that is used to perform work. Motive fluid includes but is not limited to compressed air. A control handle 155 on the supply of motive fluid 145 is used to direct motive fluid to either the bottom end of the rams 130 or the top end of the rams 130, to respectively raise and lower the air motor 125 and piston pump 120 with respect to the base plate 135. Motive fluid is provided to the air motor 125 from the supply of motive fluid 145 via a motor hose 160. The air motor 125 operates under the influence of the motive fluid to operate the piston pump 120.

The piston pump 120 includes a wiper assembly 165, a pump cylinder 170, and an outlet 175. In operation, the rams 130 are raised such that the wiper assembly 165 is lifted a sufficient distance off the base plate 135 to accommodate a container of fluid to be pumped. The wiper assembly 165 is sized to fit within the container of fluid (e.g., a 5-gallon bucket, a barrel, or other container). When it is time to pump the fluid out of the container, the rams 130 are permitted to lower under the influence of gravity or are actively lowered by motive fluid being supplied to the tops of the rams 130. As the rams 130 are lowered, the wiper assembly 165 is pushed down into the container, with the wiper 165 pushing down on the fluid to be pumped. This feeds the fluid to be pumped into the pump cylinder 170.

At the same time as the rams 130 are lowered, motive fluid is supplied to the air motor 125 and the air motor 125 drives operation (i.e., reciprocation) of the piston pump 120. Within the pump cylinder 170, a one-way valve reciprocates under the influence of the air motor 125 to force fluid up to the outlet 175. From the outlet 175, the fluid to be pumped is directed by hoses or other conduits to a desired destination. Once the wiper 165 has bottomed out in the container, or it is otherwise desired to raise the wiper 165 out of the container, the supply of motive fluid 145 provides motive fluid into the container under the wiper 165 by way of a hose 180. This supply of motive fluid to the container permits the wiper 165 to be extracted from the container without creating a vacuum in the container that might lift the container.

Figure 2:
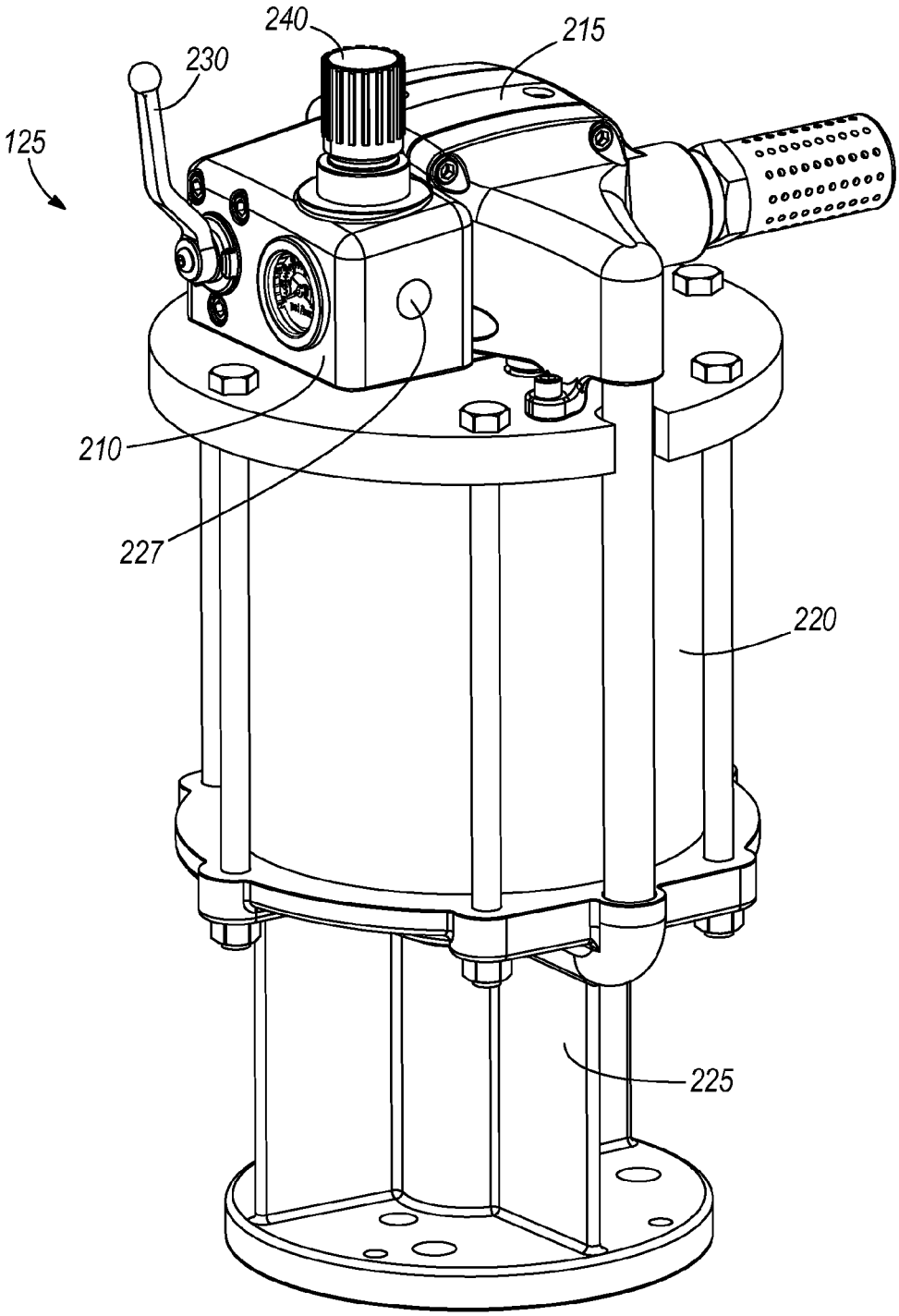
FIG. 2 is a perspective view of an air motor of the piston pump of FIG. 1.
Figure 3:
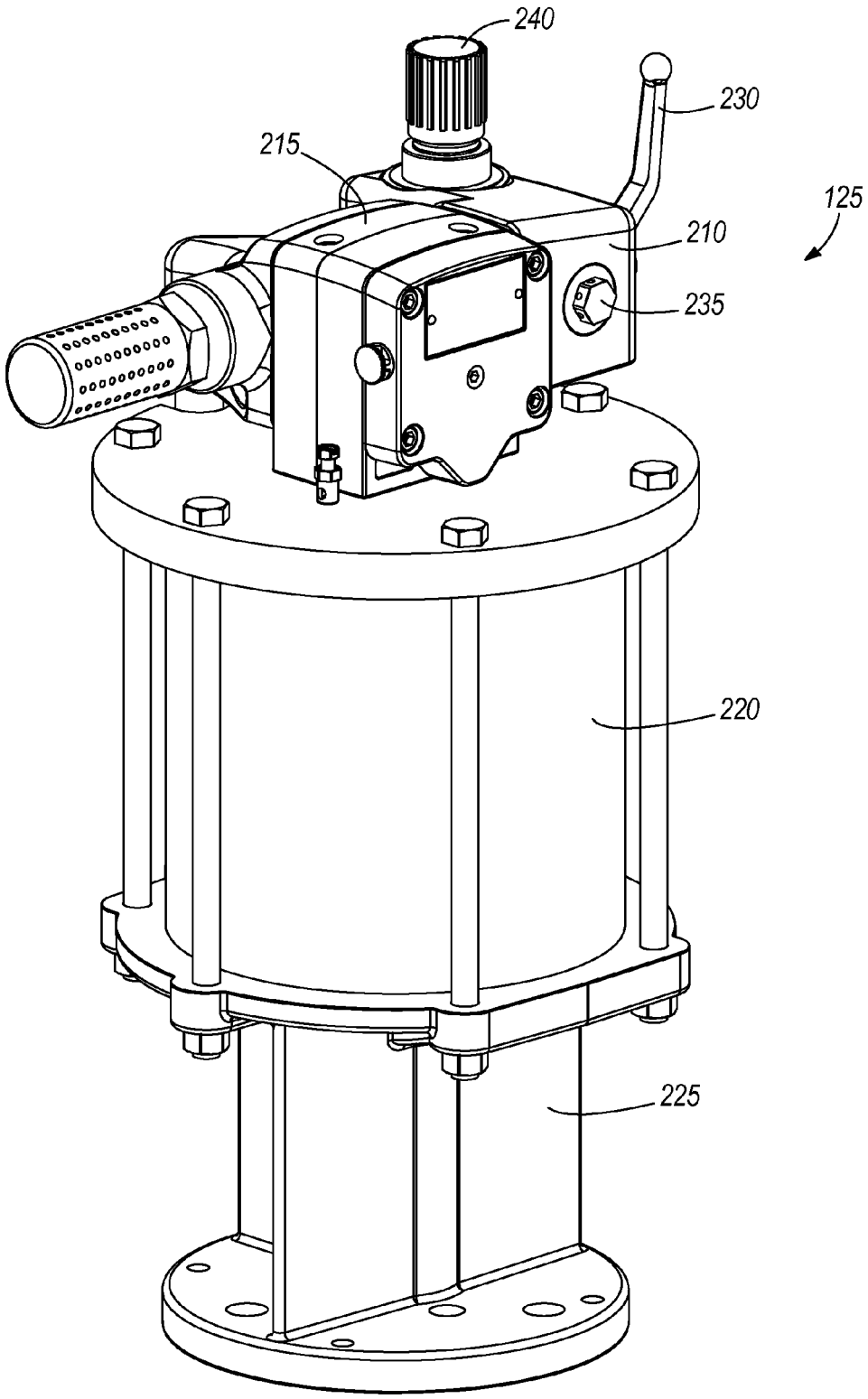
FIG. 3 is a reverse perspective view of the air motor of FIG. 2.

FIGS. 2 and 3 illustrate the air motor 125, which includes a pressure regulator assembly 210, a valve block assembly 215, a cylinder assembly 220, and a lower end assembly 225. The pressure regulator assembly 210 provides a connection point 227 for the motor hose 160 that supplies motive fluid to the air motor 125. The pressure regulator assembly 210 includes a handle 230 which has an on position, an off position, and a bleed position. In the on position, motive fluid is supplied to the air motor 125 and in the off position, motive fluid is not provide to the air motor 125. In the bleed position, operation of the air motor 125 is shut down and motive fluid is permitted to bleed out of the air motor 125 through a bleed valve 235. The pressure regulator 210 also includes a pressure adjustment handle 240, which can be rotated one way or the other to increase or decrease the pressure of motive fluid supplied to the air motor 125.

Figure 4:
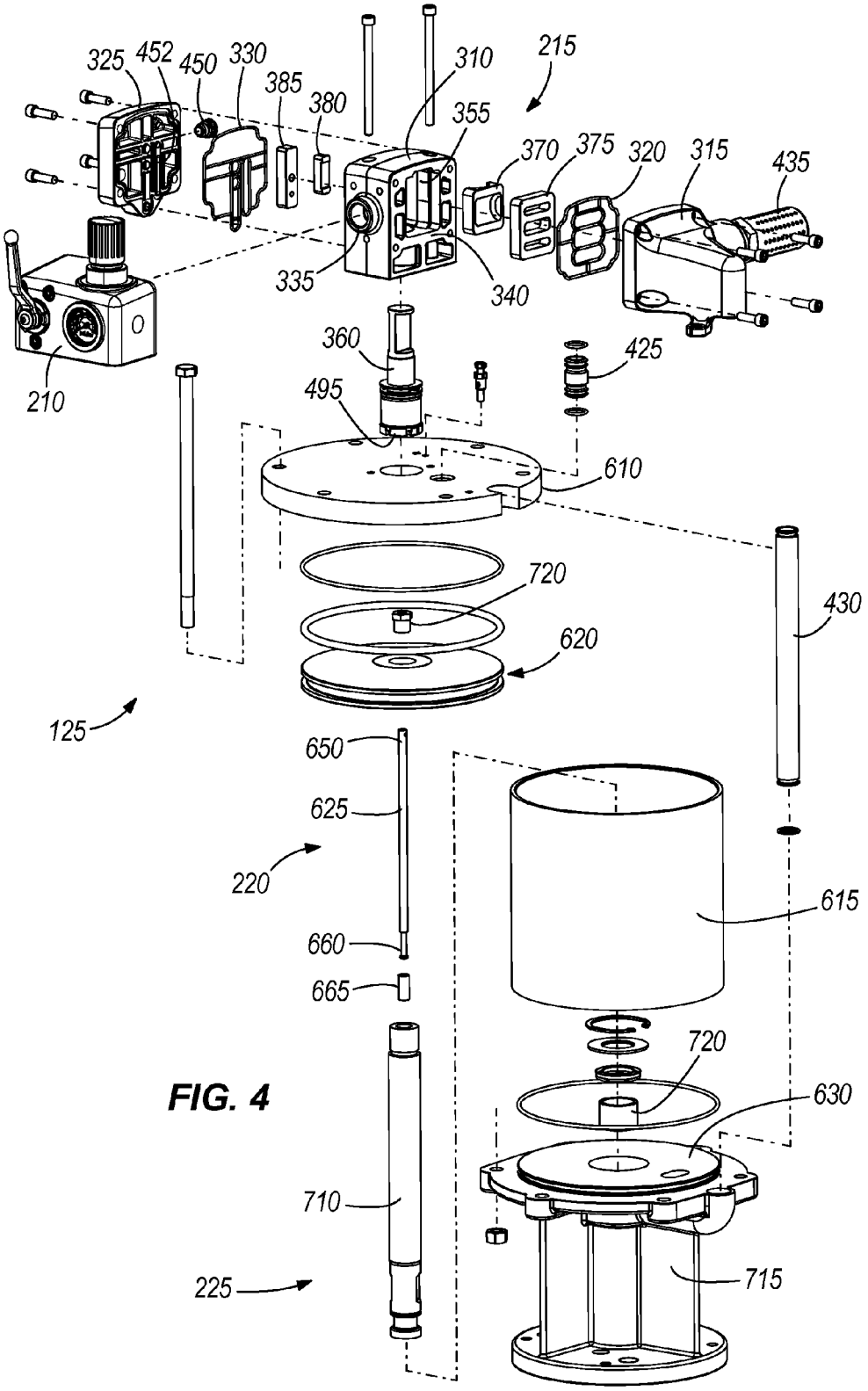
FIG. 4 is an exploded view of the air motor.
Figure 5:
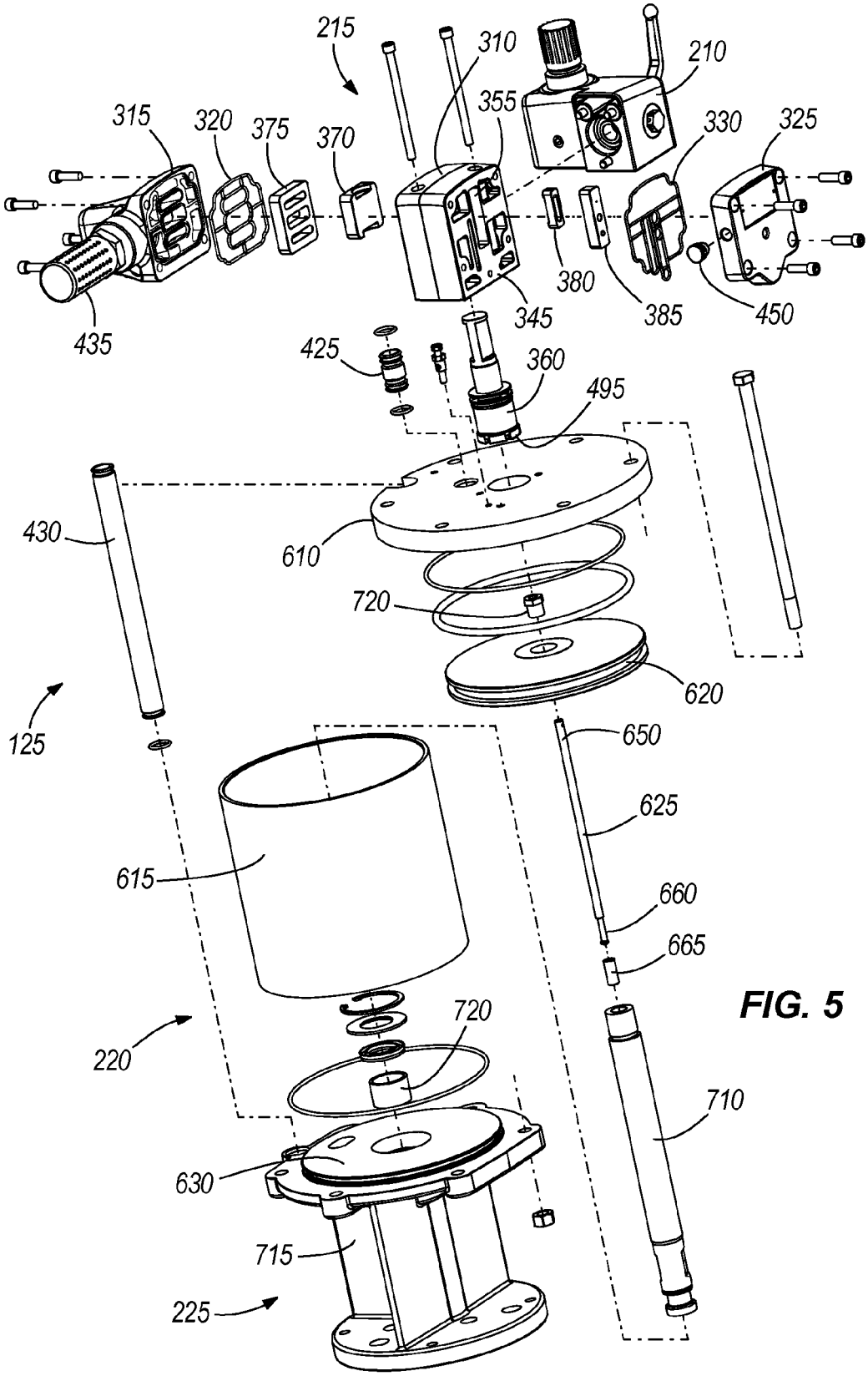
FIG. 5 is a reverse exploded view of the air motor.

With reference to FIGS. 4 and 5, the valve block assembly 215 includes a valve housing 310, a manifold cover 315, a manifold gasket 320, a pilot cover 325, and a pilot gasket 330. The valve housing 310 includes a motive fluid inlet 335, a manifold side 340, and a pilot side 345. The motive fluid inlet 335 communicates with the pressure regulator 210 to receive motive fluid for operation of the air motor 125. The manifold cover 315 and the manifold gasket 320 are mounted to the manifold side 340 of the valve housing 310, and the pilot cover 325 and the pilot gasket 330 are mounted to the pilot side 345 of the valve housing 310.

A valve chamber 355 is defined within the valve housing 310 between the manifold cover 315 and the pilot cover 325. Within the valve chamber 355 is a valve assembly, which includes a spool valve 360, a D-valve 370, a D-valve plate 375, a pilot valve 380, and a pilot valve plate 385. The spool valve 360 actually an assembly of parts, some of which will be described in more detail below. The spool valve 360 is generally centered within the valve chamber 355. The D-valve 370 and D-valve plate 375 are on the manifold side 340 of the valve housing 310, and the pilot valve 380 and pilot valve plate 385 are on the pilot side 345 of the valve housing 310.

Turning now to FIGS. 6-9, the manifold cover 315 defines an upper chamber port 410, a lower chamber port 415, and a manifold exhaust port 420. A short drop tube 425 is received within the upper chamber port 410, a long drop tube 430 is received within the lower chamber port 415, and a muffler 435 (FIGS. 4 and 5) is received within the manifold exhaust port 420. Each of the short drop tube 425, long drop tube 430, and muffler 435 may include an o-ring seal for creating an air-tight seal between the ports and the tubes or muffler received in the ports. The pilot cover 325 defines a two-way pilot conduit 440 and a pilot exhaust conduit 445. A vent plug 450 (FIGS. 4 and 5) is received within the pilot exhaust conduit 445. The pilot cover 325 further includes a dedicated exhaust conduit 452 that communicates with the pilot exhaust conduit 445.

The D-valve plate 375 includes a first D-valve port 455, a second D-valve port 460, and a D-valve exhaust port 465 between the first and second ports 455, 460. The first D-valve port 455, second D-valve port 460, and D-valve exhaust port 465 of the D-valve plate 375 register with the upper chamber port 410, lower chamber port 415, and the manifold exhaust port 420, respectively, in the manifold cover 315. The pilot valve plate 385 includes a first pilot port 470 and a second pilot port 475. The two-way pilot conduit 440 and pilot exhaust conduit 445 register with the first pilot port 470 and second pilot port 475, respectively.

The spool valve 360 includes an upper portion with a reduced-diameter section 480, a lower portion with an enlarged-diameter section 485, and a cup 487 in which the enlarged-diameter section 485 reciprocates. The enlarged-diameter section 485 includes a blind bore 490. A cover 495 secured across the opening of the blind bore 490 and held in place with a snap ring. A cup seal 510 on the outside of the enlarged-diameter section 485 creates a seal between the spool valve 360 and the valve housing 310. The portion of the valve chamber 355 below the cup seal 510 and outside of the cup 487 defines a pilot chamber 515. Immediately below the cup seal 510 is a vent bushing 517 which communicates between the inside of the cup 487 and the dedicated exhaust conduit 452. As a result, the inside of the cup 487 is constantly in communication with atmosphere through the vent bushing, dedicated exhaust conduit 452, and pilot exhaust conduit 445. This accommodates displaced and sucked in air above the head of the enlarged diameter section 485 during reciprocating movement of the spool valve 360. The two-way pilot conduit 440 communicates with the pilot chamber 515 below the vent bushing 517.

The D-valve 370 and pilot valve 380 are captured within a the reduced-diameter section 480 of the spool valve 360. As a result, the D-valve 370 and pilot valve 380 are coupled for reciprocation with the spool valve 360. The D-valve 370 includes a flat surface which abuts against and slides with respect to the D-valve plate 375. The D-valve 370 includes an arcuate, concave surface 520 that opens toward the D-valve plate 375. The flat surface of the D-valve surrounds the concave surface 520. The D-valve includes cut-outs 525 at the top and bottom which cause lost motion between the D-valve and the spool valve 360. The pilot valve 380 fits tightly within the reduced-diameter section 480 of the spool valve 360 so there is no lost motion. The pilot valve 380 includes an concave surface 530 that faces the pilot valve plate 385, and the pilot valve 380 includes a flat surface that surrounds the concave surface 530 and slides against the pilot valve plate 385.

Referring again to FIGS. 4 and 5, the cylinder assembly 220 includes a top plate 610, cylinder 615, a piston 620, an actuation rod 625, and a bottom plate 630. As shown in FIGS. 10-13, the space within the cylinder 615 between the top plate 610 and the piston 620 defines an upper chamber 635, and the space within the cylinder 615 between the bottom plate 630 and the piston 620 defines a lower chamber 640. The top plate 610 includes a top plate port 648 with which receives the lower end of the short drop tube 425. The top plate port 648 places the upper chamber port 410 and short drop tube 425 in fluid communication with the upper chamber 635. The actuation rod 625 includes a first end 650 to which a cap 655 (FIG. 6) is pinned and a second opposite end 660 to which a low friction sleeve 665 is attached.

With continued reference to FIGS. 4 and 5, the lower end assembly 225 includes an output shaft 710 and a base 715 on which the cylinder assembly 220 sits. The output shaft 710 is threaded into a central hole in the piston 620. The output shaft 710 also includes a lower end that extends into a through bore in the base 715. The lower end provides an attachment point for the piston pump assembly 120. The lower end assembly 225 also includes a bushing 720 in the base 715, to facilitate longitudinal reciprocation of the output shaft 710. As seen in FIGS. 10-13, the output shaft 710 includes a blind bore 725. A low-friction bushing 730 is fit within the upper end of the output shaft 710.

As illustrated in FIGS. 6-9, the first end 650 of the actuation rod 625 extends through the cover 495 in the enlarged-diameter section 485 of the spool valve 360, and is captured within the enlarged-diameter section 485 on account of the cap 655 being pinned to the first end 650. As illustrated in FIGS. 10-13, the second end 660 and sleeve 665 are received within the bore 725 of the output shaft 710, and are captured within the bore 725 by the low-friction bushing 730.

The base 715 includes a base port 810 into which the lower end of the long drop tube 430 is received. The base port 810 places the lower chamber port 415 and long drop tube 430 in fluid communication with the lower chamber 640.

Figure 6:
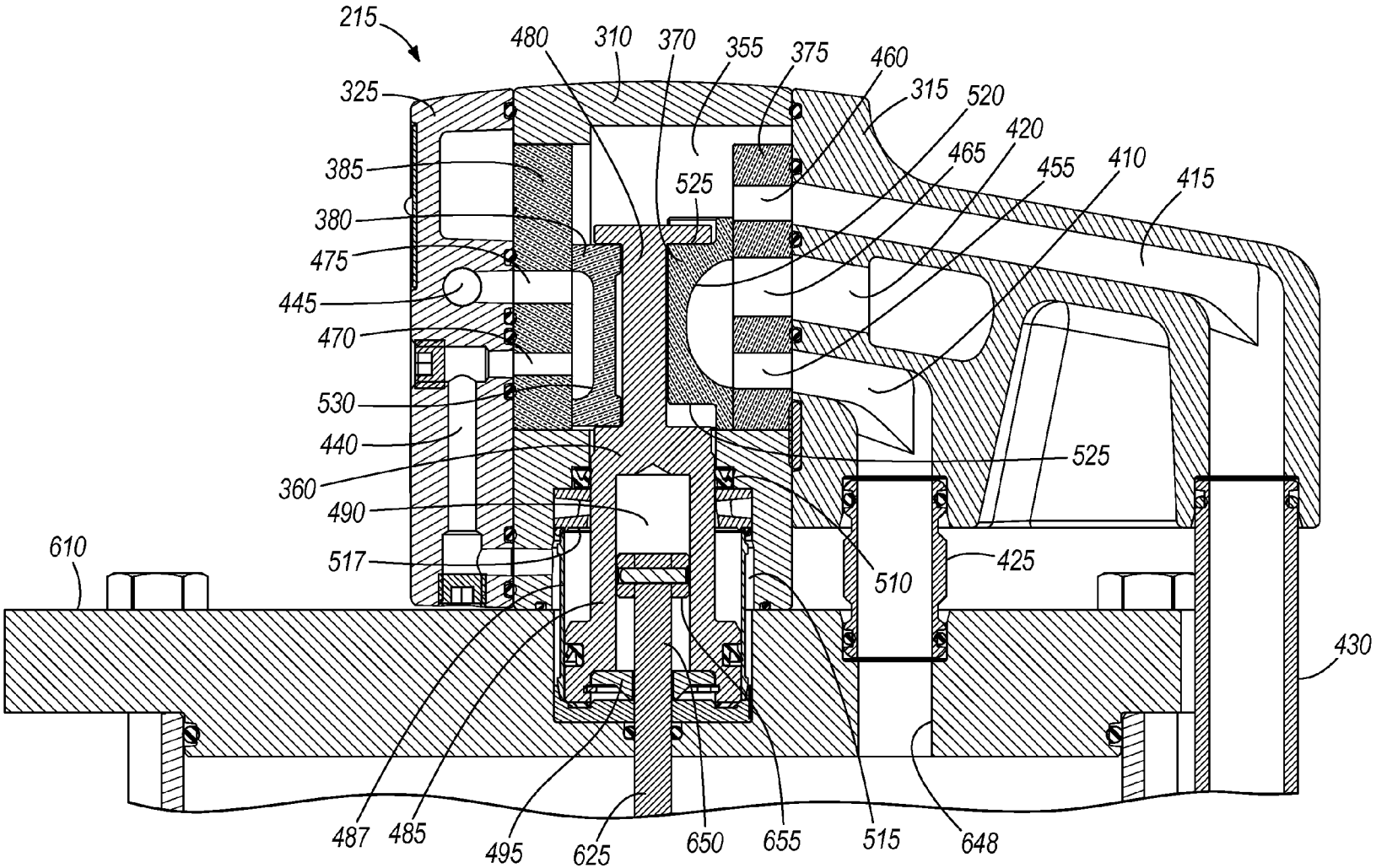
FIG. 6 is a cross-sectional view of the top end of the air motor, with the spool valve in a first position.

A cycle of operation of the valve assembly will now be described with reference to FIGS. 6-9. In FIG. 6, the spool valve 360 is in the fully-down position. The first end 650 of the actuation rod 625 is in between the top of the blind bore 490 and the cover 495 in the spool valve 360. The pilot valve 380 places the pilot chamber 515 in fluid communication with the pilot exhaust conduit 445, such that the pilot chamber 515 is at or near atmospheric pressure. The valve chamber 355 above the spool valve 360 is at the elevated pressure of the motive fluid.

The D-valve is pulled down by the spool valve 360. The upper chamber 635 is vented to atmosphere through the top plate port 648, the short drop tube 425, the upper chamber port 410, the first D-valve port 455, the concave surface 520 of the D-valve 370, the D-valve exhaust port 465, the manifold exhaust port 420, and the muffler 435. At the same time, the D-valve has uncovered the second D-valve port 460, such that motive fluid flows out of the valve chamber 355, through the second D-valve port 460, through the lower chamber port 415, through the long drop tube 430, through the base port 810, and into the lower chamber 640. As a result of this valve positioning, the piston 620 rises, which causes the actuation rod 625 to rise.

Figure 7:
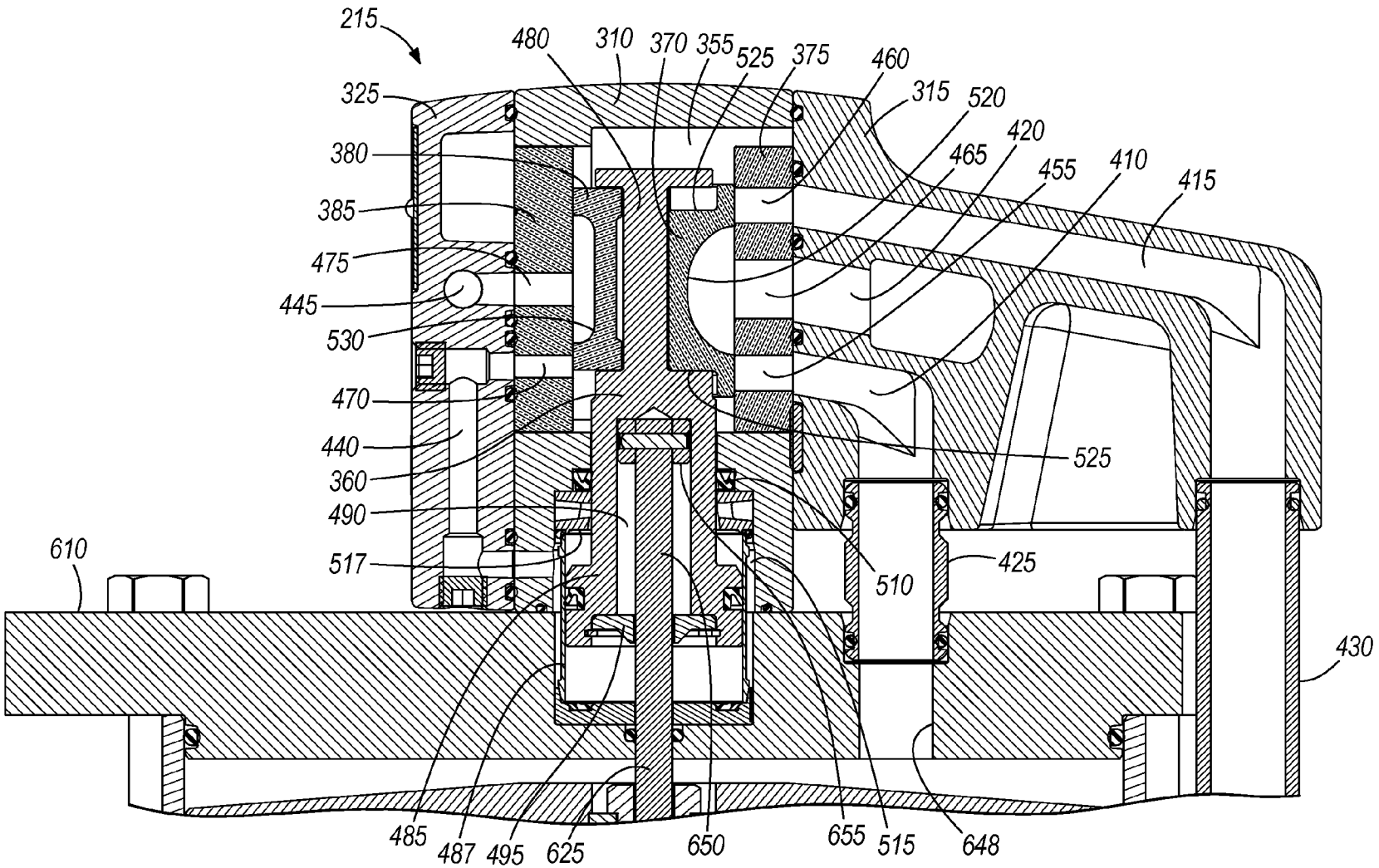
FIG. 7 is a cross-sectional view of the top end of the air motor, within the spool valve in a second position.

FIG. 7 illustrates the actuation rod 625 having risen sufficiently to overcome the lost motion associated with the top of the actuation rod 625 topping out within the blind bore 490 in the enlarged-diameter section 485 of the spool valve 360. The actuation rod 625 has also risen sufficiently to push the spool valve 360 up to a point at which the pilot valve 380 starts to uncover the first pilot port 470. Also, upward movement of the spool valve 360 has covered the lost motion associated with the D-valve 370, as the spool valve 360 has abutted the cutout surface 525 and started to move the D-valve 370 up. The flat surface of the D-valve 370 at this point covers both the first D-valve port 455 and the second D-valve port 460, so the valve chamber 355 is cut off from communication with both the upper and lower chambers 635, 640. Because the first pilot port 470 is partially uncovered by the pilot valve 380, motive fluid rushes to the pilot chamber 515 through the first pilot port 470 and the two-way pilot conduit 440. With the exception of the communication of the inside of the cup 487 with atmosphere through the vent bushing 517, the entire valve chamber 355 (both above the spool valve 360 and below the spool valve 360 in the pilot chamber 515) is at the pressure of the motive fluid.

Figure 8:
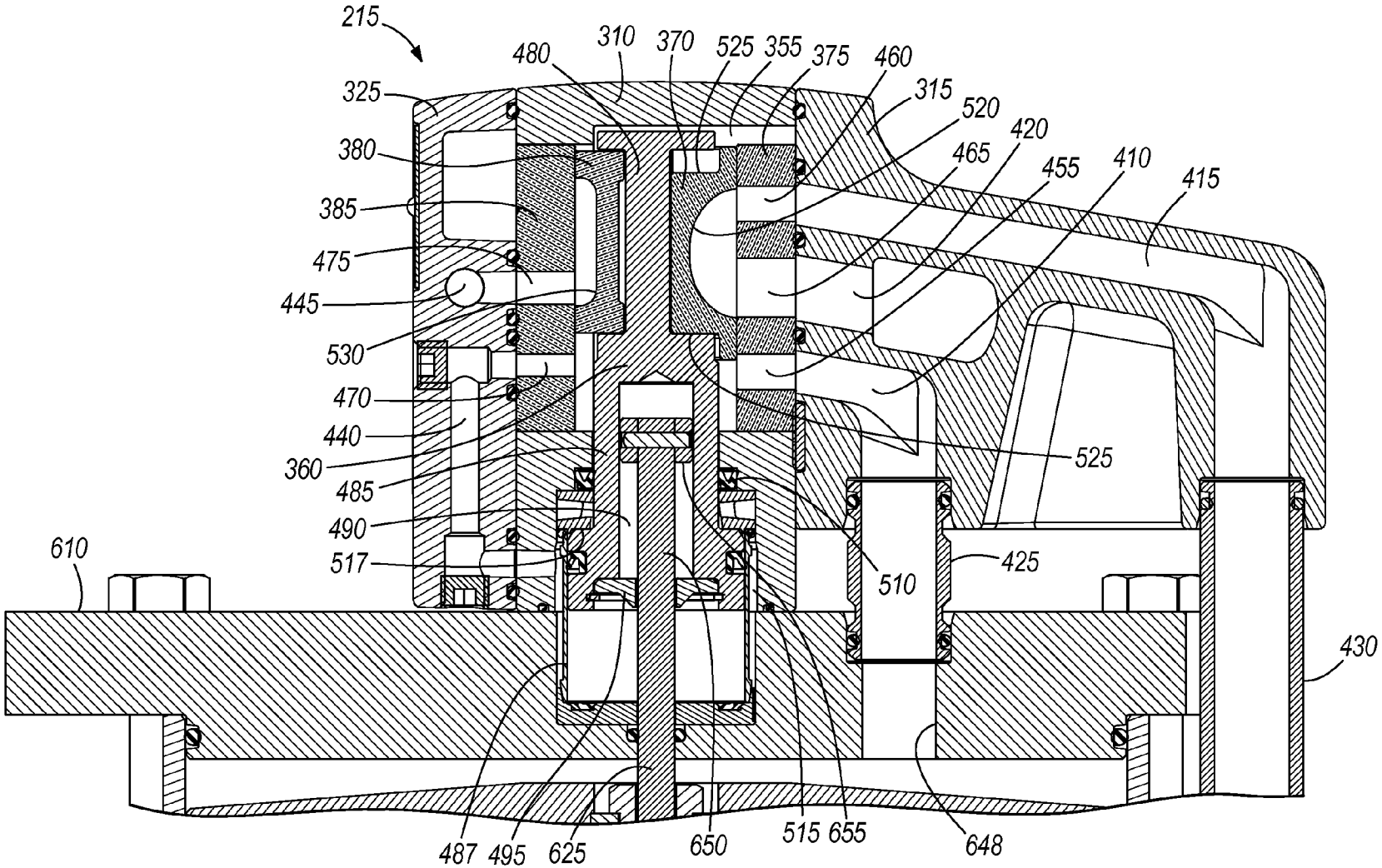
FIG. 8 is a cross-sectional view of the top end of the air motor, within the spool valve in a third position.

In FIG. 8, the spool valve 360 is topped out within the valve chamber 355. The top of the spool valve 360 has a smaller surface area than the bottom of the spool valve 360. Because the top and bottom are exposed to the same pressure, the resultant force on the bottom of the spool valve 360 is greater than the resultant force on the top of the spool valve 360. Consequently, the spool valve 360 moves up under the influence of the force difference, without the aid of the actuation rod 625. The first end 650 of the actuation rod 625 is in between the top of the blind bore 490 and the cover 495 in the spool valve 360.

The pilot valve covers the second pilot port 475 and pilot exhaust conduit 445. The lower chamber 640 is vented to atmosphere through the base port 810, the long drop tube 430, the lower chamber port 415, the second D-valve port 460, the concave surface 520 of the D-valve 370, the D-valve exhaust port 465, the manifold exhaust port 420, and the muffler 435. At the same time, the D-valve has uncovered the first D-valve port 455, such that motive fluid flows out of the valve chamber 355, through the first D-valve port 455, through the upper chamber port 410, through the short drop tube 425, through the top plate port 648, and into the upper chamber 635. As a result of this valve positioning, the piston 620 lowers, which causes the actuation rod 625 to lower.

Figure 9:
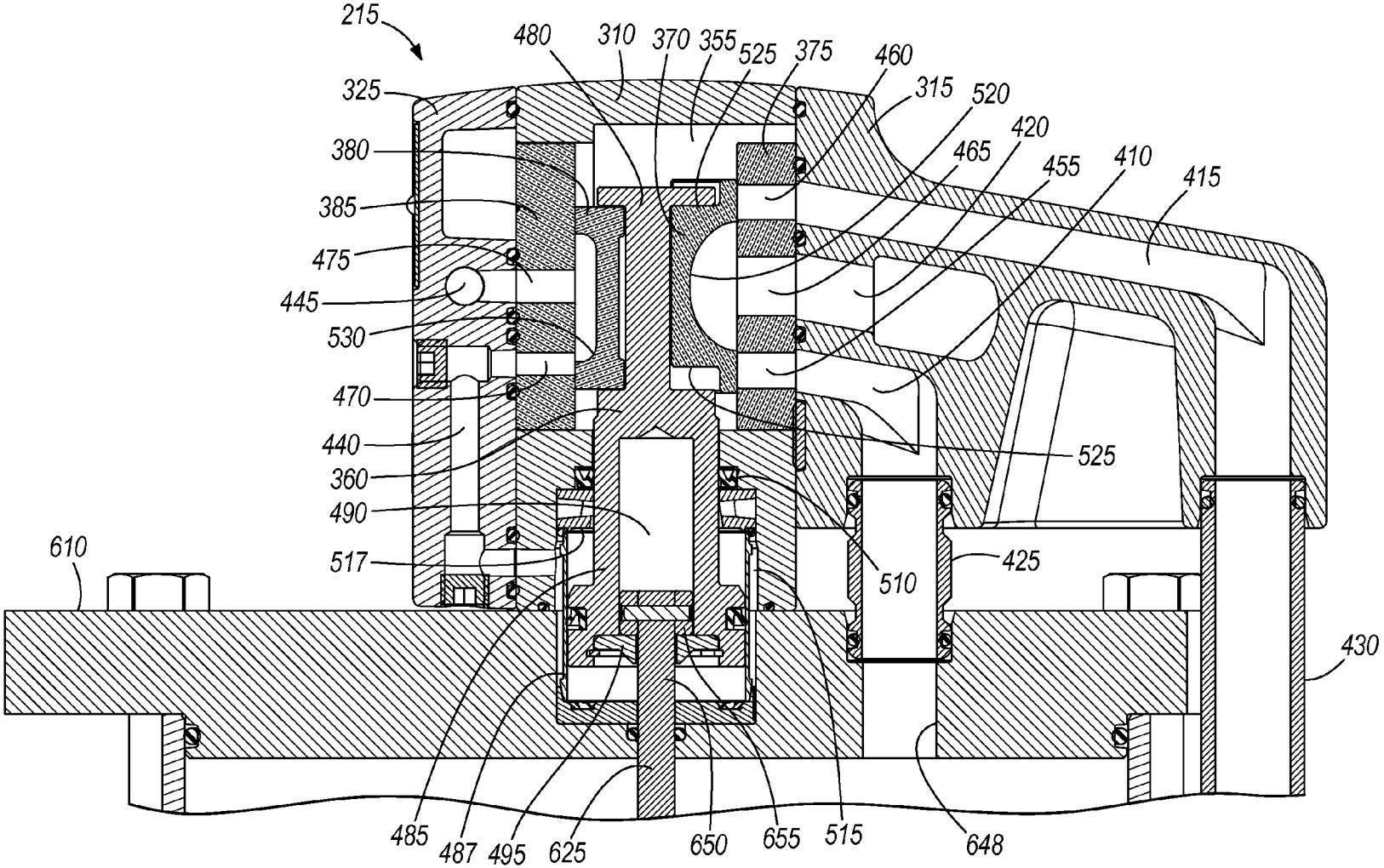
FIG. 9 is a cross-sectional view of the top end of the air motor, within the spool valve in a fourth position.

FIG. 9 illustrates a valve positioning in which the actuation rod 625 has overcome the lost motion portion of the spool valve 360 (i.e., the cap 655 has bottomed out on the cover 495), and the spool valve 360 has overcome the lost motion portion of the D-valve 370 (i.e., the top of the spool valve 360 has abutted the top cut-out 525 of the D-valve 370). The spool valve 360 has moved down sufficiently to place the first pilot port 470 in communication with the second pilot port 475 via the pilot valve 380. As a result, motive fluid flows out of the pilot chamber 515 through the two-way pilot conduit 440, the first pilot port 470, the pilot valve 380, the second pilot port 475, the pilot exhaust conduit 445, and the vent plug 450. The pilot chamber 515 is therefore at atmospheric pressure. The flat surface of the D-valve 370 at this point covers both the first D-valve port 455 and the second D-valve port 460, so the valve chamber 355 is cut off from communication with both the upper and lower chambers 635, 640.

The portion of the valve chamber 355 above the spool valve 360 is at motive fluid pressure, and the portion of the valve chamber 355 below the spool valve 360 (i.e., the pilot chamber 515) is at atmospheric pressure. As a result, the spool valve 360 is pushed down from the position in FIG. 9 to the position in FIG. 6. The D-valve 370 is moved down by the spool valve 360, which places the lower chamber 640 in communication with motive fluid and places the upper chamber 635 in communication with atmosphere, as discussed above. At this point, a cycle of operation is complete.

Figure 10:
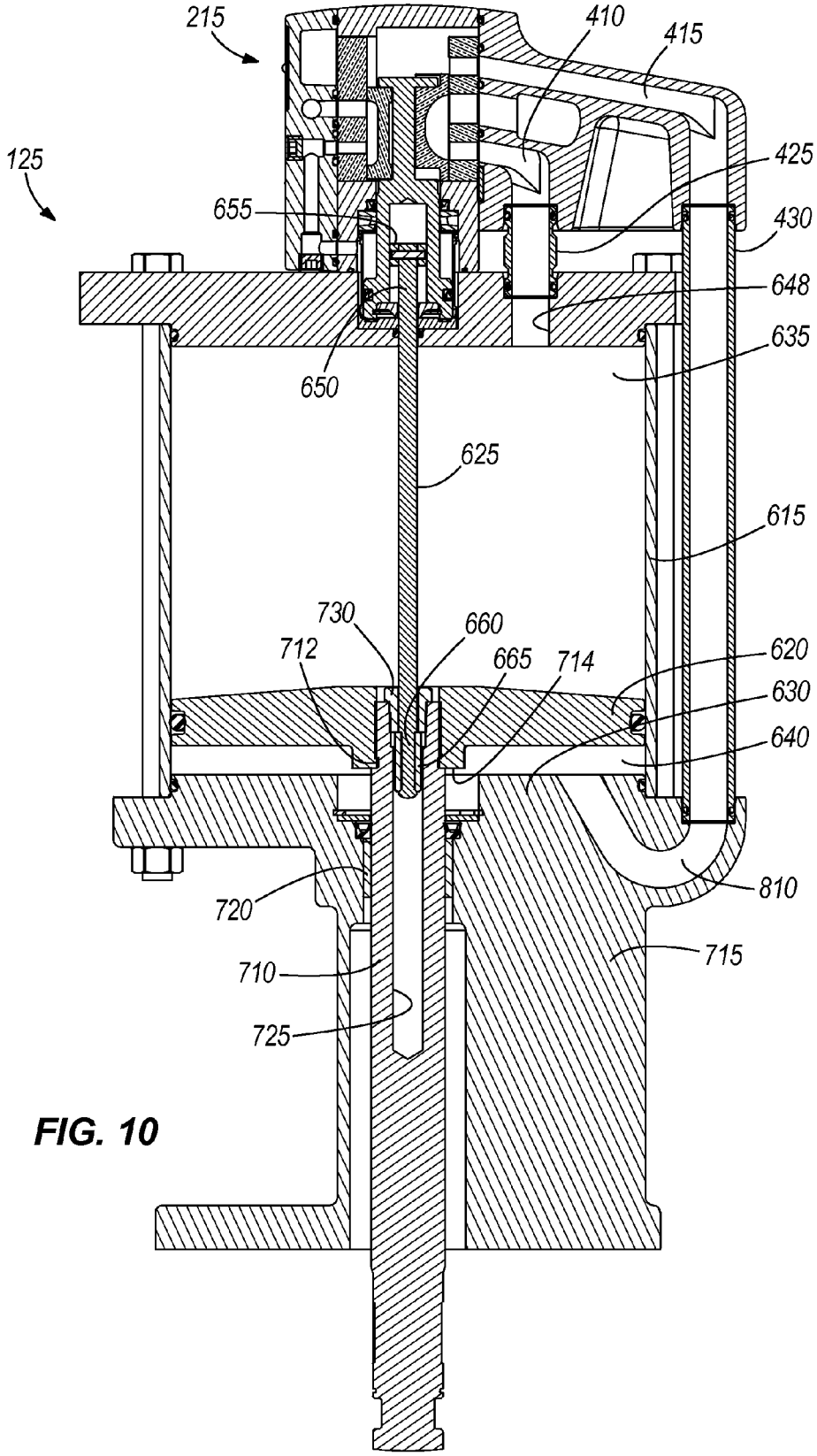
FIG. 10 is a cross-sectional view of the air motor in a first position in the operational cycle.

FIGS. 10-15 illustrate a full cycle of operation of the cylinder assembly 220 and lower end assembly 225 of the air motor 125. In FIG. 10, the piston 620 is in the fully down position, with the spool valve 360 having just shifted to its fully-down position (i.e., the position illustrated and described above with respect to FIG. 6). The sleeve 665 on the second end 660 of the actuation rod 625 is topped out within the bore 725 of the output shaft 710, against the bushing 730. Motive fluid floods into the lower chamber 640 owing to the valve positioning described above with respect to FIG. 6, and the piston starts to rise.

Figure 11:
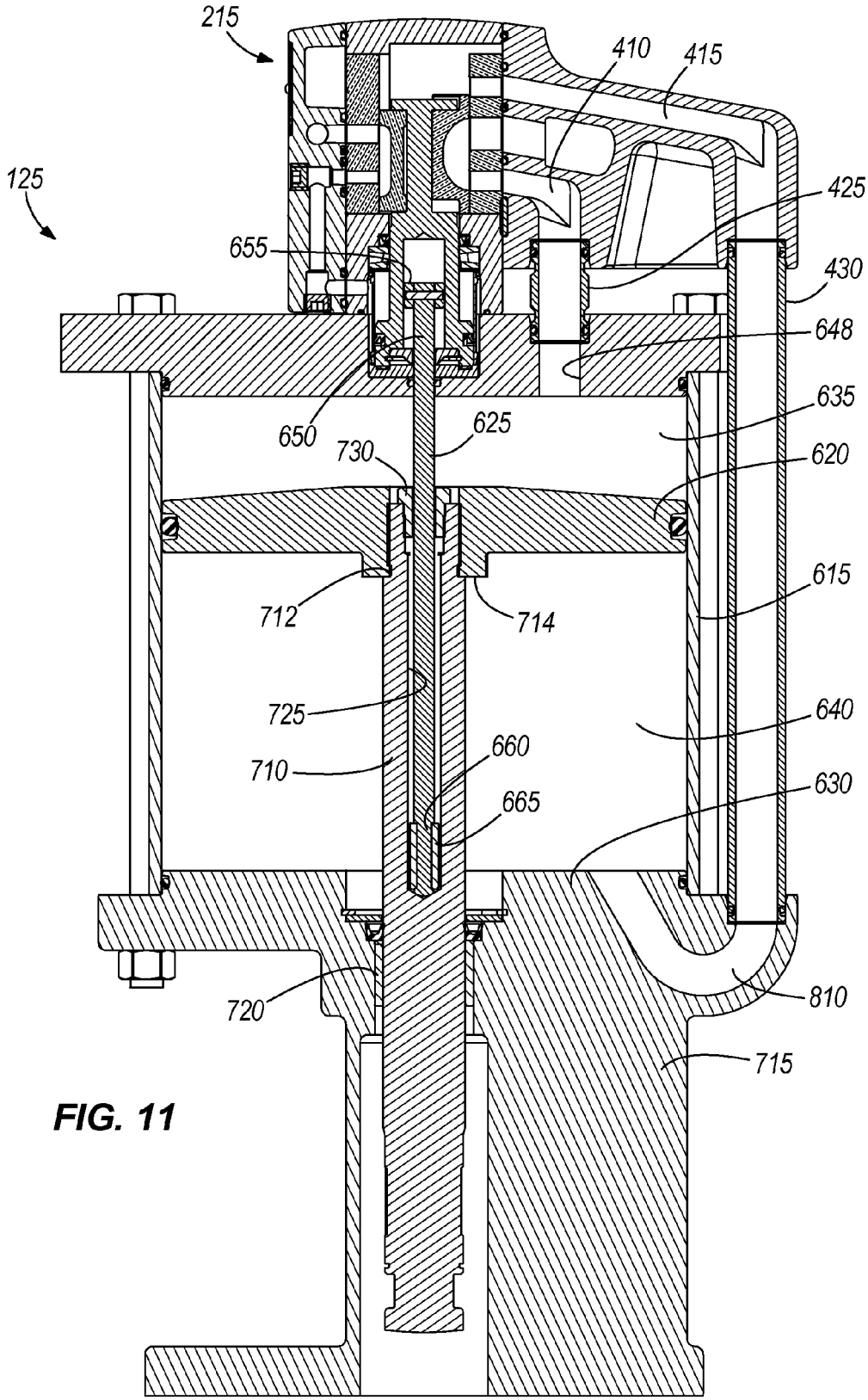
FIG. 11 is a cross-sectional view of the air motor in a second position in the operational cycle.

In FIG. 11, the piston has risen sufficiently so that the second end 660 of the actuation rod 625 bottoms out in the bore 725 of the output shaft 710, and the continued upward movement of the piston 620 pushes the actuation rod 625 up. There is therefore lost motion between the piston 620 and output shaft 710 on the one hand, and the actuation rod 625 on the other hand during the portion of upward piston movement between FIGS. 10 and 11.

Figure 12:
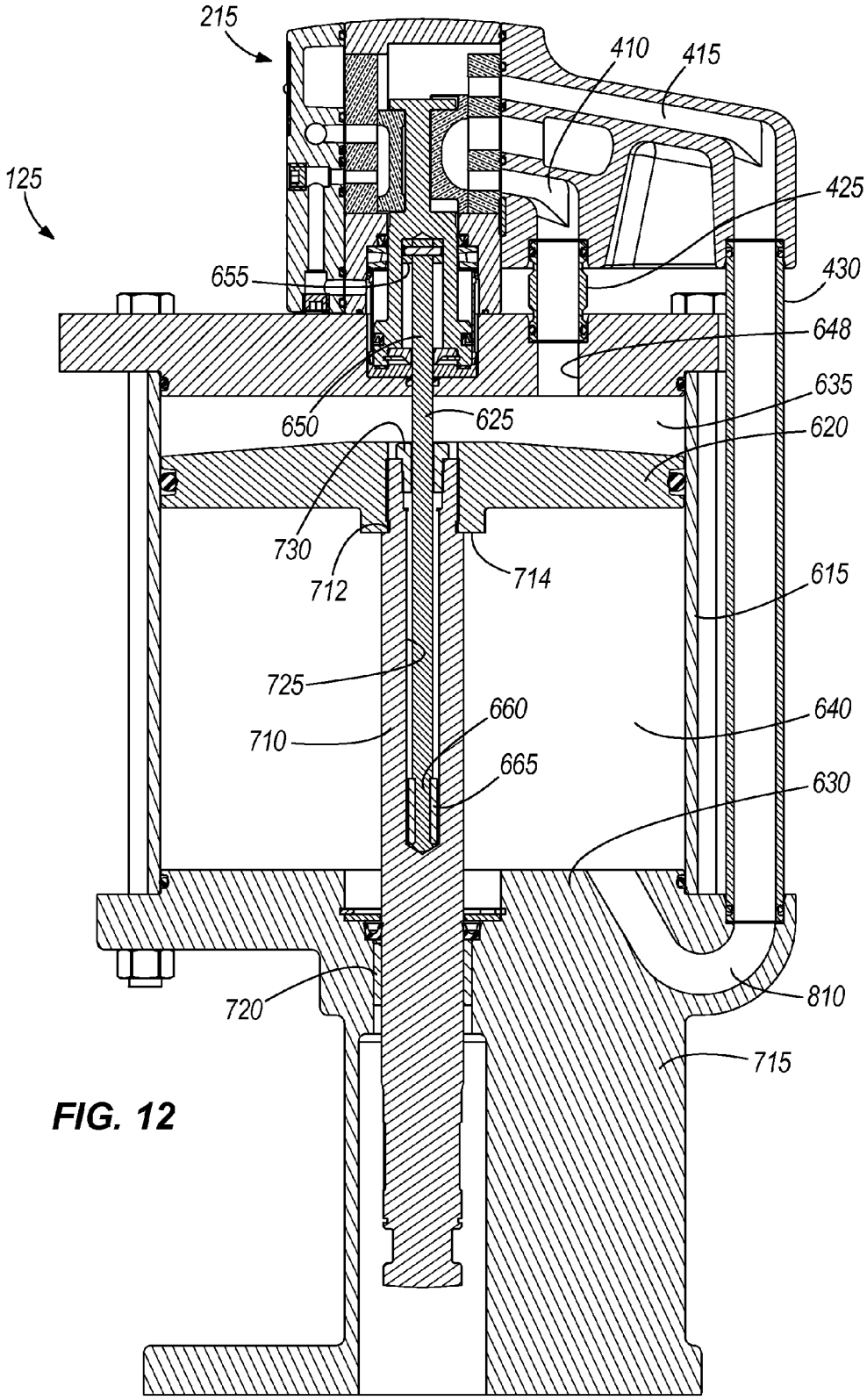
FIG. 12 is a cross-sectional view of the air motor in a third position in the operational cycle.

In FIG. 12, the piston has risen sufficiently to move the first end 650 of the actuation rod 625 into the topped out position with respect to the bore 490 in the spool valve 360, as discussed above with respect to FIG. 7. There is therefore further lost motion between the piston 620 and actuation rod 625 on the one hand, and the spool valve 360 on the other hand during the portion of upward piston movement between FIGS. 11 and 12.

Figure 13:
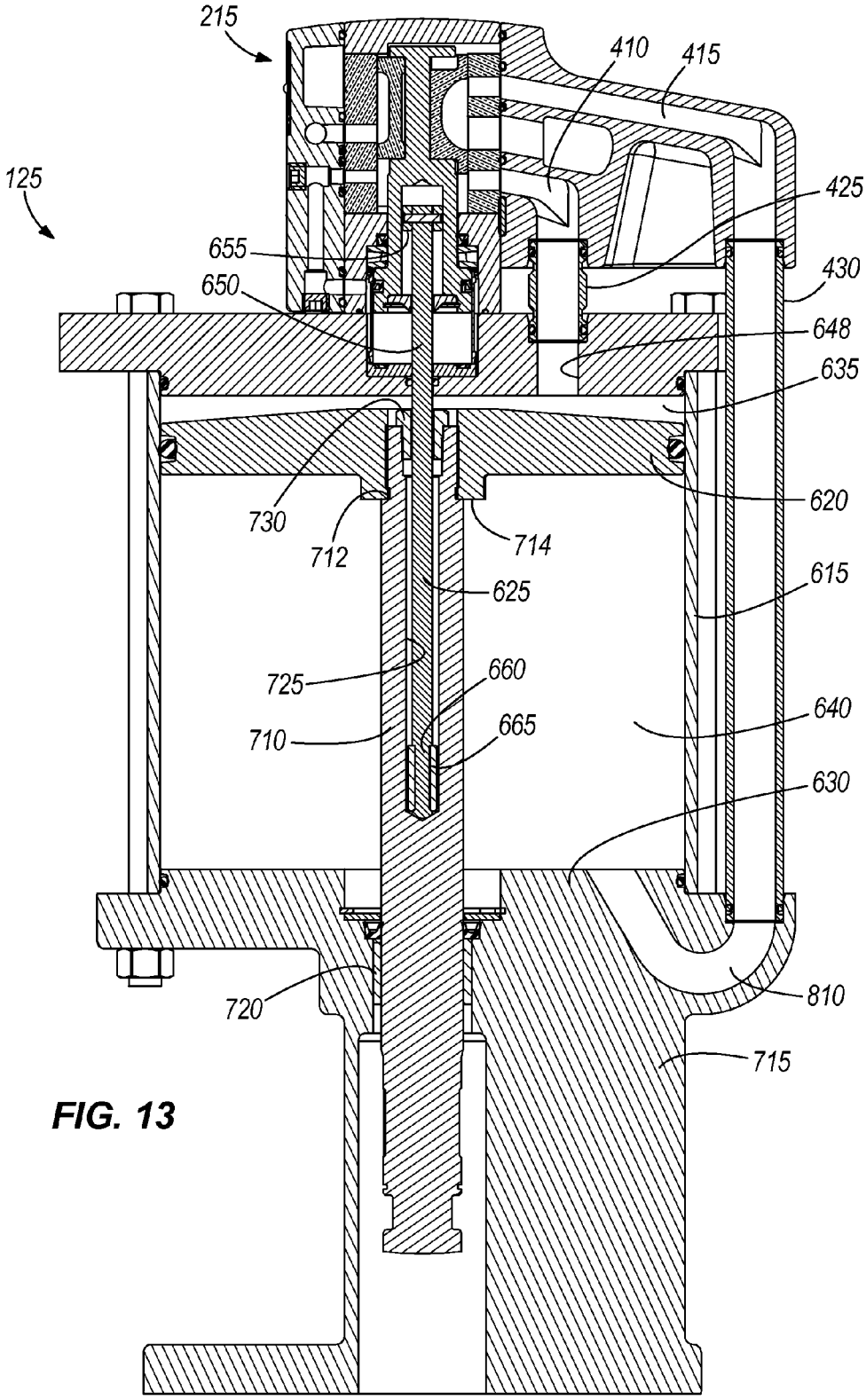
FIG. 13 is a cross-sectional view of the air motor in a fourth position in the operational cycle.

In FIG. 13, the spool valve 360 is in the full-up position as illustrated and described in FIG. 8. The top 650 of the actuation rod 625 is in between the top and bottom of the bore 490 in the spool valve 360.

Figure 14:
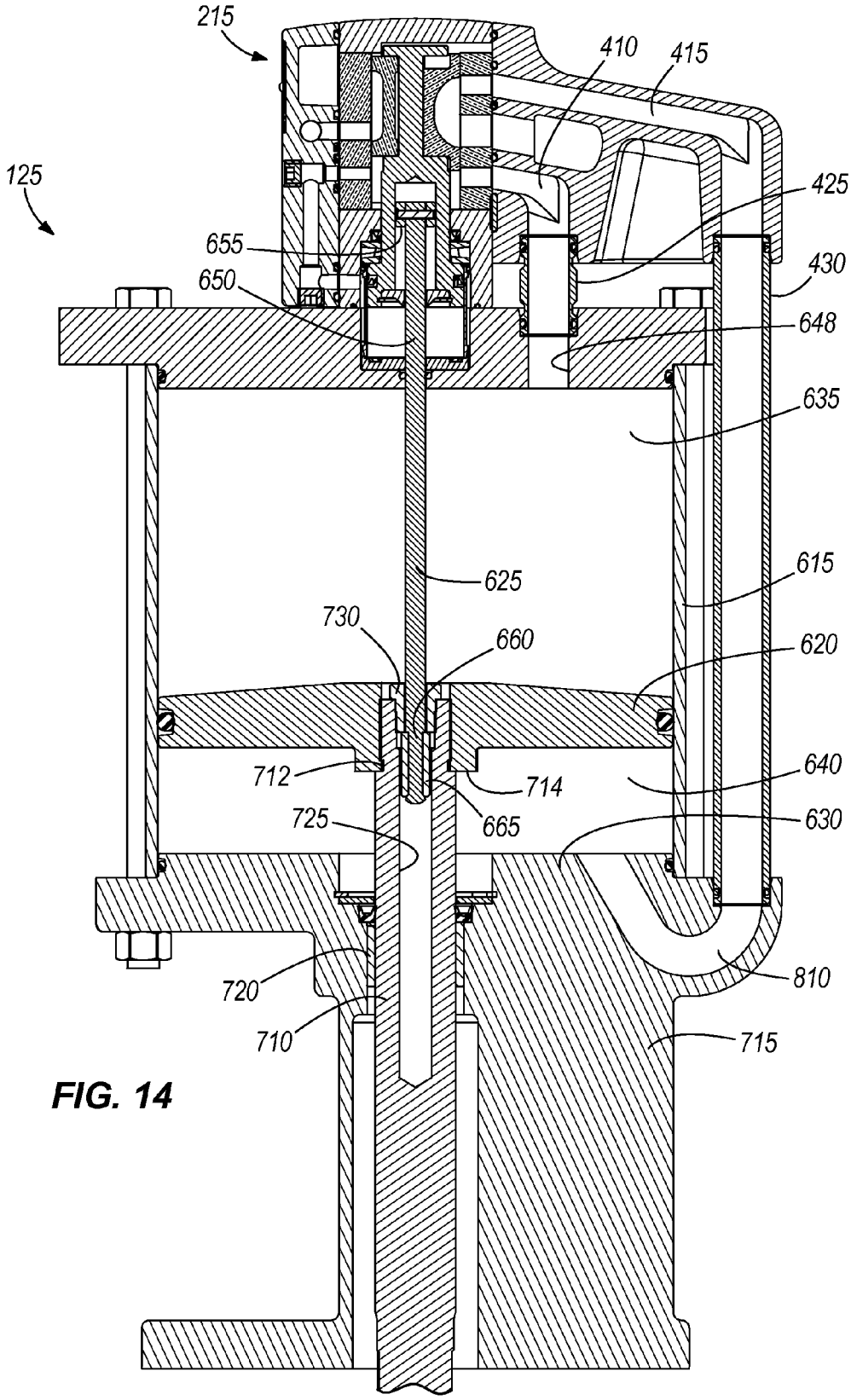
FIG. 14 is a cross-sectional view of the air motor in a fifth position in the operational cycle.

In FIG. 14, the valves 370, 380 are in the positions illustrated in FIG. 8, such that the piston 620 has started moving down. At the point illustrated in FIG. 14, the second end 660 of the actuation rod 625 has just topped out in the bore 725 of the output shaft 710, against the bushing 730. Further downward movement of the piston 620 from this position will pull the actuation rod 625 down with the piston and output shaft 710. There is therefore further lost motion between the piston 620 and output shaft 710 on the one hand, and the actuation rod 625 on the other hand between FIGS. 13 and 14.

Figure 15:
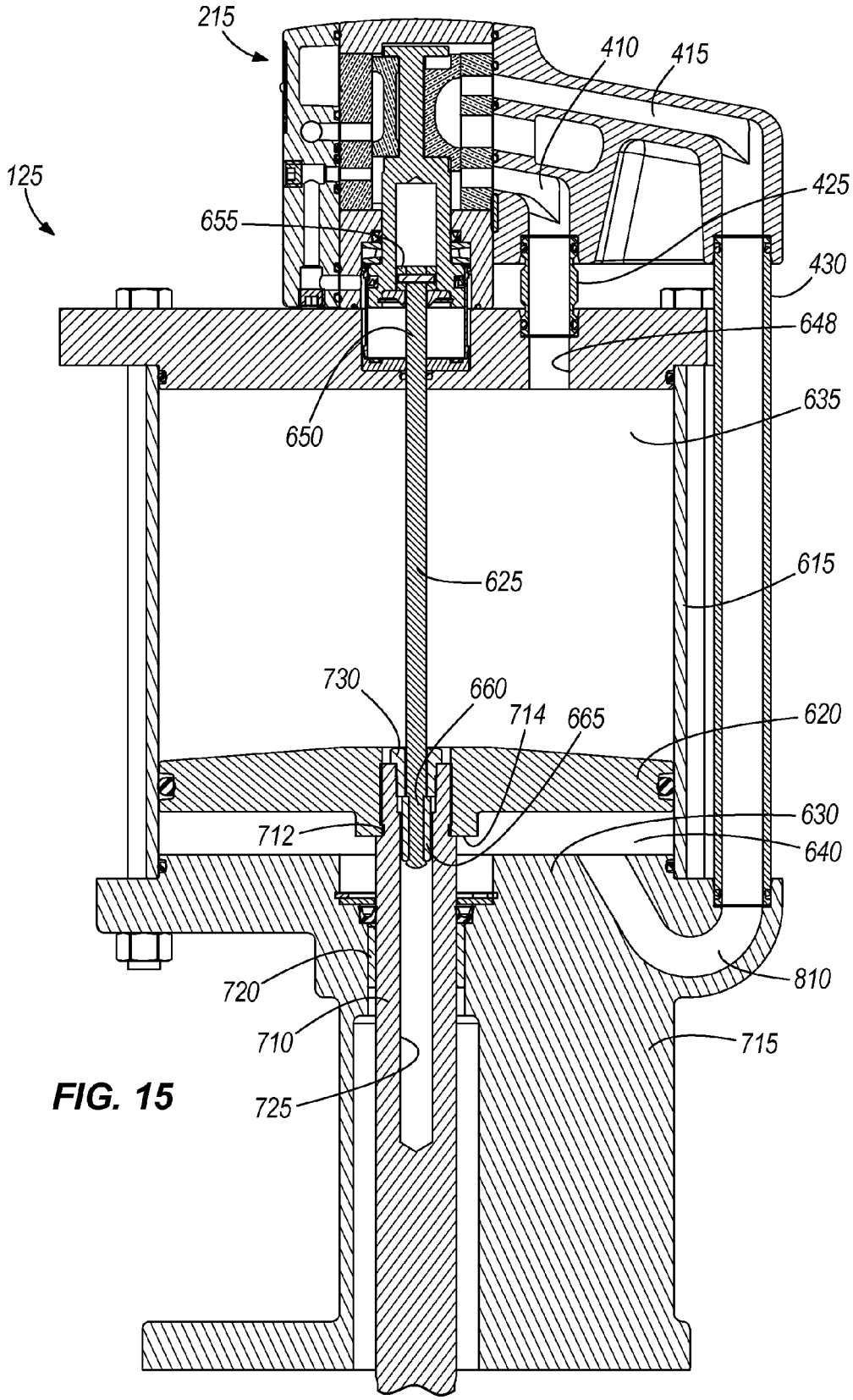
FIG. 15 is a cross-sectional view of the air motor in a sixth position in the operational cycle.

In FIG. 15, the first end 650 of the actuation rod 625 has just bottomed out in the bore 490 of the spool valve 360, with the cap 655 coming into contact with the cover 495. Further downward movement of the piston 620 from this position will pull the spool valve 360 down. There is therefore further lost motion between the piston 620 and actuation rod 625 on the one hand, and the spool valve 360 on the other hand between FIGS. 14 and 15. As the piston moves down from the position shown in FIG. 15, the spool valve reaches the positions shown in FIG. 9 and then FIG. 6, which results in motive fluid being routed to the lower chamber 640 while the upper chamber 635 is vented to exhaust through the muffler 435. Once this happens, the piston 620, actuation rod 625, and spool valve 360 are in the position illustrated in FIG. 10, and the cycle is complete.

With reference now to FIGS. 6-9, the D-valve 370, D-valve plate 375, pilot valve 380, and pilot valve plate 385 are made of ceramic material. Ceramics are more porous than other materials (metals and composites) from which valves and valve plates have been known to be constructed. The porosity of ceramics reduces the surface area contact between the valves and valve plates, which in turn reduces friction between those components. As a consequence, it is less likely that significant staking forces will develop between ceramic valves and ceramic valve plates. Another advantage of the porosity of ceramics is that it is better able to handle a dirty air environment than the smooth finish on a metal or composite part.

In contrast to ceramics, metal and composite materials will erode relatively quickly in a dirty air environment. Additionally, due to the surface finishes required of metals and composites to obtain a pneumatic seal, staking forces can arise between the metal or composite valves and plates that are excessive. The staking forces can give rise to inefficiencies of the air motor. The air motor must deliver sufficient actuation force (i.e., piston size for a given motive fluid flow and pressure) to overcome friction between parts such as valves and valve plates. Because the use of ceramics may reduce friction between the valves and valve plates, savings and operating economies may be achieved by reducing piston size and motive fluid consumption, compared to air motors that deliver the same output but have metal or composite valves and valve plates.

Thus, the invention provides, among other things, an air motor for a piston pump assembly, the air motor including ceramic valves and valve plates. Various features and advantages of the invention are set forth in the following claims.

What is claimed is:

1. An air motor comprising:

a motive fluid inlet (335) adapted to receive a flow of motive fluid;

a cylinder (615);

a piston (620) within the cylinder (615), the piston (620) dividing the cylinder (615) into an upper chamber (635) above the piston (620) and a lower chamber (640) below the piston (620);

a valve chamber (355) including a pilot chamber portion (515);

a spool valve (360) shiftable between first and second positions, the spool valve (360) including a reduced diameter section (480) and an enlarged diameter section (485), the enlarged diameter section (485) being exposed to the pilot chamber portion (515);

a ceramic D-valve plate (375) including a first D-valve port (455) communicating with the upper chamber (635), a second D-valve port (460) communicating with the lower chamber (640), and a D-valve exhaust port (465) communicating with atmosphere;

a ceramic D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position;

a ceramic pilot valve plate (385) including a first pilot port (470) communicating with the pilot chamber portion (515) and a second pilot port (475) communicating with atmosphere;

a ceramic pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position;

an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position; and an output rod (710) interconnected for reciprocal movement with the piston (620) and adapted to perform work.

2. A pump assembly comprising:

a motive fluid inlet (335) adapted to receive a flow of motive fluid;

a cylinder (615);

a piston (620) within the cylinder (615), the piston (620) dividing the cylinder (615) into an upper chamber (635) above the piston (620) and a lower chamber (640) below the piston (620);

a valve chamber (355) including a pilot chamber portion (515);

a spool valve (360) shiftable between first and second positions, the spool valve (360) including a reduced diameter section (480) and an enlarged diameter section (485), the enlarged diameter section (485) being exposed to the pilot chamber portion (515);

a ceramic D-valve plate (375) including a first D-valve port (455) communicating with the upper chamber (635), a second D-valve port (460) communicating with the lower chamber (640), and a D-valve exhaust port (465) communicating with atmosphere;

a ceramic D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position;

a ceramic pilot valve plate (385) including a first pilot port (470) communicating with the pilot chamber portion (515) and a second pilot port (475) communicating with atmosphere;

a ceramic pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position;

an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position;

an output rod (710) interconnected for reciprocal movement with the piston (620); and a piston pump (120) including a pump cylinder (170), an outlet (175), and a one-way valve supported for reciprocation within the pump cylinder (170) and operable to move fluid from below the one-way valve toward the outlet (175), the one-way valve being interconnected with the output rod (710) to cause reciprocation of the one-way valve to move a fluid to be pumped from within the cylinder (170) out the outlet (175) to a desired destination.

3. The pump assembly of claim 2, further comprising a manifold cover (315) adjacent a surface of the ceramic D-valve plate (375) opposite a surface against which the ceramic D-valve flat surface slides, the manifold cover (315) including an upper chamber port (410) extending along a first axis, the upper chamber port (410) communicating with the first D-valve port (455).

4. The pump assembly of claim 3, further comprising a top plate (610) mounted on the cylinder (615) and defining a top end of the upper chamber (635), the top plate (610) including a top plate port (648) extending along a second axis, wherein the second axis is non-collinear with the first axis.

5. The pump assembly of claim 4, further comprising a drop tube (425) communicating between the upper chamber port (410) and the top plate port (648) and extending along a third axis, wherein the third axis is substantially collinear with the second axis.

6. The pump assembly of claim 5, wherein the drop tube (425) has a substantially constant internal diameter.

7. The pump assembly of claim 5, further comprising a first seal positioned between the drop tube (425) and the manifold cover (315) and a second seal positioned between the drop tube (425) and the top plate (610).

8. The pump assembly of claim 2, further comprising a pressure regulator assembly (210) including a connection point (227) for supplying the flow of motive fluid to the motive fluid inlet (335).

9. The pump assembly of claim 8, wherein the pressure regulator assembly (210) further includes a handle (230) moveable between an on position in which the flow of motive fluid is supplied to the motive fluid inlet (335) and an off position in which the flow of motive fluid is not supplied to the motive fluid inlet (335).

10. The pump assembly of claim 9, wherein the pressure regulator assembly (210) further includes a bleed valve (235), wherein the handle (230) is further moveable to a bleed position, and wherein, when the handle (230) is in the bleed position, motive fluid is permitted to flow out of the pressure regulator assembly (210) through the bleed valve (235).

11. The pump assembly of claim 10, wherein the pressure regulator assembly (210) further includes a pressure adjustment handle (240) which is operable to control a pressure of the flow of motive fluid.

12. The air motor of claim 1, further comprising a manifold cover (315) adjacent a surface of the ceramic D-valve plate (375) opposite a surface against which the ceramic D-valve flat surface slides, the manifold cover (315) including an upper chamber port (410) extending along a first axis, the upper chamber port (410) communicating with the first D-valve port (455).

13. The air motor of claim 12, further comprising a top plate (610) mounted on the cylinder (615) and defining a top end of the upper chamber (635), the top plate (610) including a top plate port (648) extending along a second axis, wherein the second axis is non-collinear with the first axis.

14. The air motor of claim 13, further comprising a drop tube (425) communicating between the upper chamber port (410) and the top plate port (648) and extending along a third axis, wherein the third axis is substantially collinear with the second axis.

15. The air motor of claim 14, wherein the drop tube (425) has a substantially constant internal diameter.

16. The air motor of claim 14, further comprising a first seal positioned between the drop tube (425) and the manifold cover (315) and a second seal positioned between the drop tube (425) and the top plate (610).

17. The air motor of claim 1, further comprising a pressure regulator assembly (210) including a connection point (227) for supplying the flow of motive fluid to the motive fluid inlet (335).

18. The air motor of claim 17, wherein the pressure regulator assembly (210) further includes a handle (230) moveable between an on position in which the flow of motive fluid is supplied to the motive fluid inlet (335) and an off position in which the flow of motive fluid is not supplied to the motive fluid inlet (335).

19. The air motor of claim 18, wherein the pressure regulator assembly (210) further includes a bleed valve (235), wherein the handle (230) is further moveable to a bleed position, and wherein, when the handle (230) is in the bleed position, motive fluid is permitted to flow out of the pressure regulator assembly (210) through the bleed valve (235).

20. The air motor of claim 19, wherein the pressure regulator assembly (210) further includes a pressure adjustment handle (240) which is operable to control a pressure of the flow of motive fluid.

* * * * *